US009038550B2

(12) United States Patent
Spliethoff et al.

(10) Patent No.: US 9,038,550 B2
(45) Date of Patent: May 26, 2015

(54) GRATE BAR FOR AN INCINERATOR AND METHOD FOR PRODUCING SUCH A GRATE BAR

(75) Inventors: Bernd Spliethoff, Bielefeld (DE); Michael Mimor, Bad Salzuflen (DE); Gerald Gruener, Bielefeld (DE); Nils Plagge, Espelkamp (DE)

(73) Assignee: Baumgarte Boiler Systems GmbH, Bielefeld (DE)

( * ) Notice: Subject to any disclaimer, the term of this patent is extended or adjusted under 35 U.S.C. 154(b) by 238 days.

(21) Appl. No.: 13/258,295

(22) PCT Filed: Mar. 29, 2010

(86) PCT No.: PCT/EP2010/001981

§ 371 (c)(1),
(2), (4) Date: Sep. 21, 2011

(87) PCT Pub. No.: WO2010/115541

PCT Pub. Date: Oct. 14, 2010

(65) Prior Publication Data

US 2012/0012037 A1 Jan. 19, 2012

(30) Foreign Application Priority Data

Apr. 8, 2009 (DE) ..... 10 2009 016 523

(51) Int. Cl.

| | |
|---|---|
| ***F23K 3/00*** | (2006.01) |
| ***F23H 17/12*** | (2006.01) |
| ***F23H 7/08*** | (2006.01) |

(52) U.S. Cl.

CPC ..... *F23H 17/12* (2013.01); *F23H 7/08* (2013.01); *F23H 2900/17001* (2013.01); *F23H 2900/17002* (2013.01)

(58) Field of Classification Search

CPC . F23H 7/08; F23H 17/12; F23H 2900/17002; F23H 2900/17001; F23H 3/02; F23K 3/12; F23K 3/00; F23L 9/00

USPC ..... 110/267, 281, 108, 109, 268, 328, 275, 110/278, 285, 286, 289

See application file for complete search history.

(56) References Cited

U.S. PATENT DOCUMENTS 4,078,883 A * 3/1978 Arnold ..... 432/239
4,437,452 A * 3/1984 Reschly ..... 126/182

(Continued)

FOREIGN PATENT DOCUMENTS

DE 32368 C 7/1885
DE 1055821 4/1959

(Continued)

OTHER PUBLICATIONS

International Search Report; PCT/EP2010/001981; Sep. 14, 2011.

(Continued)

*Primary Examiner* — Kenneth Rinehart
*Assistant Examiner* — Bao D Nguyen
(74) *Attorney, Agent, or Firm* — Studebaker & Brackett PC

(57) ABSTRACT

A grate bar for an incinerator having a grate bar base body and a high temperature resistant cover plate covering the grate bar base body at least on a surface portion which in operation points to a combustion chamber. The cover plate is separated from the grate bar base body by a thermal insulating material. In the grate bar base body a cavity is inserted in a side pointing to the cover plate and/or in the cover plate in the side pointing to the grate bar base body, which cavity is at least partially filled with a ceramic fiber insulating material. The invention further relates to a method for producing such a grate bar.

15 Claims, 7 Drawing Sheets

(56) References Cited

U.S. PATENT DOCUMENTS

Figure 1:
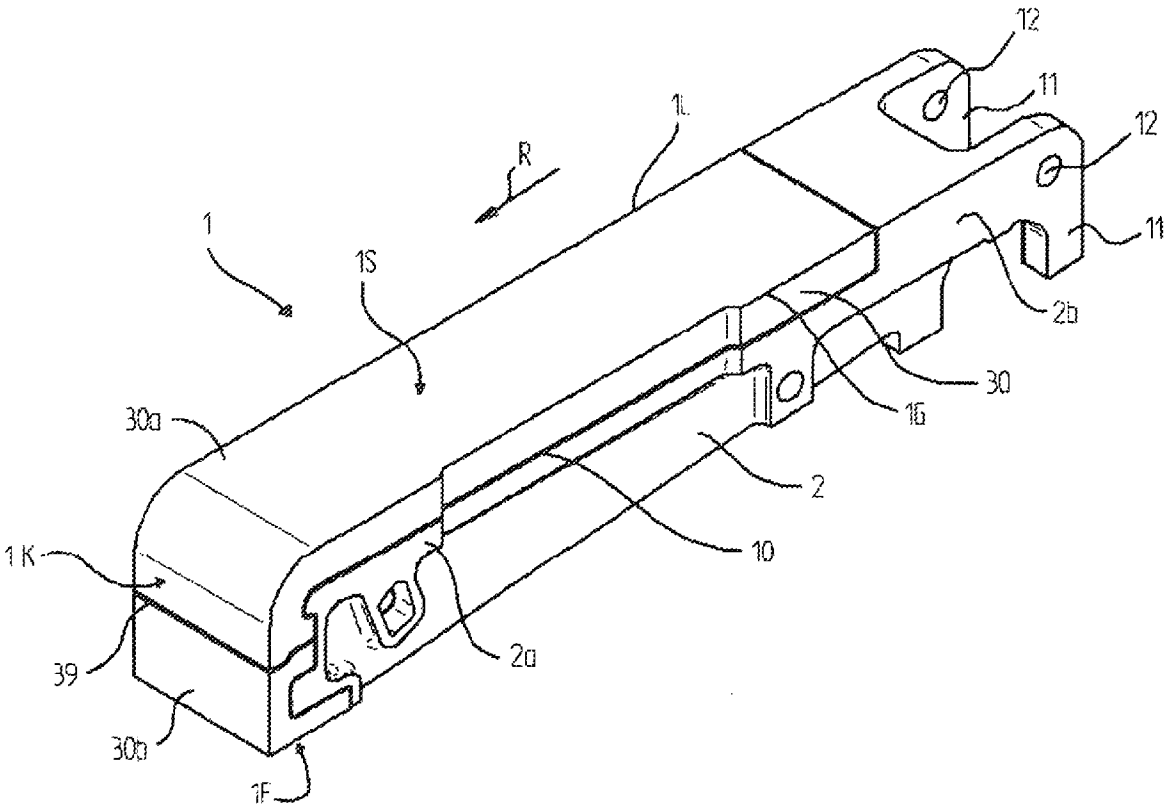

| | | | | |
|---|---|---|---|---|
| 4,457,703 | A * | 7/1984 | Ross | 432/13 |
| 5,033,396 | A | 7/1991 | Pauli | |
| 5,088,262 | A * | 2/1992 | Miller et al. | 52/745.21 |
| 5,724,898 | A * | 3/1998 | von Bockh et al. | 110/291 |
| 5,775,238 | A * | 7/1998 | Hauser | 110/282 |
| 6,269,756 | B1 * | 8/2001 | Sachs et al. | 110/298 |
| 7,021,928 | B1 * | 4/2006 | Fehsenmayr et al. | 432/78 |
| 7,284,491 | B2 * | 10/2007 | Williams et al. | 110/281 |
| 2003/0172856 | A1 * | 9/2003 | Hofmann et al. | 110/338 |
| 2004/0159269 | A1 | 8/2004 | Williams et al. | |
| 2006/0213405 | A1 * | 9/2006 | Zimmermann | 110/268 |

FOREIGN PATENT DOCUMENTS

| | | | |
|---|---|---|---|
| DE | 2149064 | | 4/1973 |
| DE | 2454202 | A1 * | 5/1976 |
| DE | 3314098 | A1 | 1/1984 |
| DE | 3618606 | A1 | 12/1987 |
| DE | 3804815 | A1 | 9/1988 |
| DE | 38 01 407 | A1 | 7/1989 |
| DE | 4109396 | A1 | 9/1992 |
| DE | 9312738 | | 11/1993 |
| DE | 9312738 | U1 * | 12/1993 |
| DE | 19714573 | C1 | 4/1998 |
| DE | 19733946 | A1 | 2/1999 |
| DE | 19857416 | A1 * | 6/2000 |
| DE | 102006009898 | A1 | 9/2007 |
| EP | 0170803 | A1 | 2/1986 |
| EP | 0345285 | A1 | 12/1989 |
| EP | 0382045 | A2 | 8/1990 |
| EP | 0743488 | A2 | 11/1996 |
| EP | 0870988 | A2 | 10/1998 |
| EP | 1008806 | A2 | 6/2000 |
| EP | 1705425 | A1 | 9/2006 |
| FR | 2894012 | | 6/2007 |
| GB | 188422 | | 11/1922 |
| JP | 09-221372 | A | 8/1997 |
| JP | 09-296922 | A | 11/1997 |
| WO | 02/052197 | A1 | 7/2002 |
| WO | 2007/107024 | A1 | 9/2007 |

OTHER PUBLICATIONS

The first Office Action issued by the State Intellectual Property Office of the People's Republic of China on Sep. 4, 2013, which corresponds to Chinese Patent Application No. 201080022916.7 and is related to U.S. Appl. No. 13/258,295; with translation.

* cited by examiner

GRATE BAR FOR AN INCINERATOR AND METHOD FOR PRODUCING SUCH A GRATE BAR

The present invention relates to a grate bar for an incinerator having a grate bar base body and a high temperature resistant cover plate covering the grate bar base body at least on a surface portion which in operation points to a combustion chamber, where the cover plate is separated from the grate bar base body by a thermal insulating material. Furthermore, the invention relates to a method for producing such a grate bar.

Grate bars of the type specified initially are used in firing grates for incinerators, in particular in incinerator plants for solid fuels. These solid fuels can, for example, comprise waste, substitute fuels such as, for example, sorted and/or prepared waste, secondary fuels, biomass or similar. Such a firing grate usually consists of a grate construction having a plurality of grate steps arranged one above the other in the manner of roofing tiles, each comprising a plurality of grate bars mounted parallel adjacent to one another. The roofing-tile-like arrangement of the grate bars thereby forms the grate layer on which the fuel bed is transported through the combustion chamber and on which the combustion takes place. The combustion is maintained by primary air, which is usually passed in, among other things, through gaps between the grate bars from below into the combustion chamber. For movement of the fuel bed, the firing grate is frequently configured so that the grate bars of every other grate step can be moved to and fro in the longitudinal direction of the grate bars whilst the grate bars of the remaining grate steps are held fixed. Due to the cyclic to and fro movement of every other grate step, during combustion the fuel bed is transported obliquely downwards on the roofing-tile-like grate construction from a preheating zone into a main combustion zone and further to a post-combustion zone.

In such an incineration plant temperatures of continuously 800 to 1300° C. or briefly even higher are produced. The entire front part of the grate bars which project below the grate bars of the grate step located thereabove inside the roofing-tile-like layering is consequently exposed to high thermal stresses. Added to this are appreciable mechanical stresses due to transport of the fuel bed and the to and fro movement of every other grate step. In addition, particularly in solid fuel incineration plants there is the problem that the grate bars are exposed to chemical attack resulting from the special composition of the fuel in this area of application.

In order to reduce the thermal stresses there are various possibilities for cooling the grate bars. Thus, there are systems which operate with air cooling. In this case, air which is usually required in any case to maintain combustion, is passed by the grate bars to cool them. In high-temperature applications however, the air cooling is hitherto frequently not sufficient to ensure satisfactorily high service lives of the grate bars. Replacing damaged grate bars, which is only possible when the entire plant is at a standstill for a fairly long time, in turn causes high costs. Therefore systems which operate with water cooling, possibly also additionally, are usually used. However, such systems are relatively expensive since pipes must be inserted in the grate bars and the grate bars must each be integrated into cooling water circuit to be achieved. In addition, problem-free function of the complete cooling water circuit must be achieved permanently and appropriate safety systems must be installed for this purpose. Without the cooling provided, the service lives of the grate bars would be appreciably reduced.

Another possibility for increasing the service lives of the grate bars is the structure of multilayer grate bars of the type specified initially. For this purpose, for example, the grate bar base body is made of steel, preferably as a steel casting. The surface portion pointing to the combustion chamber during operation, i.e. the side carrying the fuel bed, is then covered with a high temperature resistant cover plate, particularly preferably made of ceramic. Such structures having a steel base body and a ceramic cover plate are described for example in EPO 382 045 A2 and EP1 705 425 A1. DE 93 12 738 U1 describes grate bars which comprise a fastening element as a base body and a cover plate made of ceramic fastened thereon, where either an air gap or a continuous insulating nonwoven is located between the fastening element and the cover plate for insulation in order to completely separate the cover plate from the fastening element. Furthermore, a grate bar comprising a base body made of cast iron or steel and an upper layer of porcelain material has already been described in DE 32368 A, where the porcelain plate and the grate bar base body made of steel or iron are separated by a thin layer of a poorly heat-conducting material. A certain thermal unloading of the grate bar base body can certainly be achieved by such a simple insulating layer. Nevertheless, in the temperature ranges usually achieved today, this is not yet sufficient to provide a grate bar with sufficiently long service lives for air-cooled grate systems. Therefore, the more expensive water-cooled systems are usually used in modern solid fuel incineration plants.

It is therefore an object of the present invention to provide an improved grate bar of the type specified initially and a method for producing such a grate bar which can be used in modern high-temperature solid fuel incineration plants even with simple air cooling, with sufficiently long service lives.

According to the invention, therefore a cavity having peripheral walls, i.e. a cavity having walls running around it, is inserted in the grate bar base body in a side pointing towards the cover plate and/or in the cover plate in the side pointing towards the grate bar base body, which cavity is at least partially filled with a ceramic fibre insulating material. This ceramic fibre insulating material is on the one hand high-temperature resistant itself. On the other hand, it has a considerably higher insulating effect than usual thermal insulating materials such as insulating cement, for example. In particular by introducing the ceramic fibre insulating material into a cavity which forms a closed interior space in the grate bar due to the grate bar base body with the cover plate, it is ensured that the ceramic fibre insulating material has a certain room for expansion so that a certain amount of air is always included in the insulating material which contributes to a very high thermal insulation between the cover plate and the grate bar base body. Overall, therefore the thermal stress on the grate bar base body is significantly reduced compared with the known grate bars, even at very high fuel bed temperatures up to 1000° C. and higher. Even with simple air cooling, grate bar service lives can be achieved in such installations such as otherwise are only attainable with water cooling. Overall therefore, firing grates constructed with the grate bars according to the invention are more economical to produce and particularly in continuous operation are more cost-effective than hitherto known firing grates with water cooling.

In the method according to the invention for producing a grate bar, a grate bar base body is produced, for example, cast from steel casting and covered with a high temperature resistant cover plate at least on a surface portion which in operation points to a combustion chamber. At the same time, during manufacture of the grate bar base body a cavity is inserted in the grate bar base body in a side pointing to the cover plate and/or during manufacture of the cover plate a cavity is inserted in the cover plate in a side pointing to the grate bar base body. Before assembling the grate bar base body and the cover plate this cavity is then filled at least partially with a ceramic fibre insulating material.

The following description contains particularly advantageous further developments and embodiments of the invention, where the method according to the invention can also be further developed similarly to the grate bar conversely.

The cover plate can fundamentally be made of various high-temperature resistant materials. Preferably this comprises a ceramic cover plate since ceramic materials are not only high temperature resistant but additionally also have a high resistance to chemical stresses. Particularly preferably this is a silicon carbide (SiC) ceramic. A silicon-infiltrated reaction-bound SiC material has proved particularly suitable which usually has a good oxidation and corrosion resistance, a very good thermal shock resistance and a very high breaking strength.

Since, as already mentioned above, the surface of the fuel rod is also exposed to mechanical stresses, the cover plate should have a certain minimum thickness. Particularly preferably the thickness of the cover plate is at least 5 mm, particularly preferably at least 10 mm. Quite particularly preferably the thickness lies between 15 and 35 mm. As also mentioned, the cavity for receiving the ceramic insulating material can also be inserted into the cover plate. However, in order that the cover plate need not be made too thick and nevertheless achieve the highest possible stability of the cover plate, the cavity is preferably located at least predominantly or even exclusively in the grate bar base body. By appropriately configuring the casting mould, in particular when manufacturing the grate bar in the steel casting method, a suitable cavity can be inserted in the grate bar base body without major increased expenditure. Alternatively, the cavity or even the complete grate bar base body can be produced by or in combination with a machining method.

Various substances of different consistency and design come into question as ceramic fibre insulating material. For example, a loose flaky ceramic fibre insulating material can be used. Preferably however, an insulating material in the form of a ceramic fibre insulating mat is used. Such a ceramic fibre insulating mat can easily be processed by, for example, cutting it to fit the cavity and inserting. It additionally has a defined thickness so that a precisely defined insulating effect can be achieved thereby.

A ceramic fibre material is preferably used which contains as main components $SiO_2$ (preferably >60 wt.-%) and CaO (preferably >25 wt.-%). In addition, such a ceramic fibre mat can contain MgO, $Al_2O_3$ or $Fe_2O_3$ as additional components, where the latter two substances are preferably used in the order of magnitude of 1 wt. % or lower and the MgO is preferably in a quantity between 2 and 10 wt. %. The average fibre diameter is preferably between 3 and 3.5 μm. At an average temperature of 800° C. the thermal conductivity is only 0.23 Watt/m K at a density of 128 kg/m$^3$.

In the surface regions adjacent to the cavity, which form the walls of the cavity, an insulating cement layer or an insulating adhesive layer is preferably located between the grate bar base body and the cover plate. This is considerably thinner than the layer height of the ceramic fibre insulating material or the depth of the cavity. This insulating cement layer or an insulating adhesive layer ensures that in the regions in which the grate bar base body and cover plate are not separated by the ceramic fibre insulating material, a certain thermal insulation is achieved. In addition, this layer serves to compensate for small unevennesses in the upper side of the grate bar base body and the underside of the cover plate in order to ensure a secure position of the cover plate and thereby increase the breaking strength. Preferably such an insulating cement layer or an insulating adhesive layer is located around the cavity between the grate bar base body and the cover plate. In this way, the ceramic fibre insulating material is enclosed particularly tightly and protected against effects from the combustion chamber, particularly against fuel and combustion products liquefied by the combustion, in particular solid fuel, penetrating into the ceramic fibre insulating material and reducing the insulating effect.

In order that the regions adjacent to the cavity which are not as well thermally insulated as the region of the cavity, are as small as possible, the width of the cavity preferably extends at least over 80% of a width of the cover plate, i.e. the grate bar width. The length of the cavity preferably extends at least over 60% of a length of the cover plate so that most of the region of the cover plate in contact with the fuel bed is protected.

The depth of the cavity and the layer thickness of the ceramic fibre insulating material are preferably selected so that the ceramic fibre insulating material when grate bar base body and cover plate are assembled, is not pre-tensioned or is at most pre-tensioned by a defined amount between the grate bar base body and the cover plate, i.e. is compressed between grate bar base body and cover plate. When the ceramic fibre insulating material is not subject to any pressure at all, it has the maximum thermal insulating effect. On the other hand, due to a specific pre-tension which however should not be so strong that the insulating material is compressed completely, but that sufficient air still remains in the ceramic fibre insulating material, it can be ensured that impacts exerted from the fuel chamber side onto the cover plate are suppressed downwards. In a particularly preferred exemplary embodiment, the thickness of the ceramic fibre insulating material corresponds exactly to the depth of the cavity plus a thickness of the insulating cement layer or an insulating adhesive layer or is at best minimally greater. The depth of the cavity is preferably between 5 mm and 20 mm, particularly preferably between 8 mm and 15 mm.

The cover plate is preferably configured such that it completely covers the grate bar base body towards the combustion chamber starting from a foot region on which the grate bar in the mounted state rests on a grate bar of a grate step located thereunder, over a head or front side up to and including the upper side region of the grate bar exposed to the combustion chamber. At the same time the cover plate is particularly preferably configured to be two-part, comprising an upper part plate and a head part. The upper part plate and the head part are thereby separated from one another at a separation point or separation line located on the head side, running transversely to a grate bar longitudinal direction. The separation point or the separation line is preferably located in a central region of the head side, that is approximately at mid height between the foot region and the upper side of the grate bar. Such an interruption of the cover plate on the head side has the advantage that the mechanical stresses on the cover plate are reduced. Due to the cyclic to and fro movement of every other grate step, the cover plate is exposed to a particular mechanical loading in the foot region where a force is continuously exerted on the foot region in the longitudinal direction of the grate bar. This force leads in particular to a torque at the separation point between the upper side of the grate bar and the head side of the grate bar so that a fracture could easily occur here. Due to the separation of the cover plate into an upper part plate and a head part on the head side, it is avoided that such a torque is exerted on the cover plate by the feed movement. The separation point itself is preferably configured to be stepped, i.e. both the head part and the upper part plate have stepped ends matched to one another, which engage in one other. As a result, no liquid and/or fine-particle fuel can enter between the cover plate and the grate bar base body.

Such a two-part structure of the cover plate is fundamentally appropriate in all grate bars formed with a grate bar base body and a separate cover plate regardless of whether and in which way an insulating layer or an insulating material is located between the two. In this respect, regardless of the structure of the insulating layer according to the invention, an appreciable improvement of the service lives of such grate bars is achieved by this idea. A particularly long service life can be achieved, however, by the described combination of the embodiment according to the invention of the insulation between cover plate and grate bar base body and the two-part configuration of the cover plate.

In a method for producing such a grate bar, during manufacture the cover plate is already made in two parts comprising an upper part plate and a head part. These components are mounted on the grate bar base body so that the upper part plate covers the grate bar base body in an upper side region and on a head side of the grate bar up to a separation point running transversely to a grate bar longitudinal direction in the head area and starting from this separation point, the head bar covers the grate bar base body in the further head area and a foot area of the grate bar.

There are various possibilities for the connection of cover plate and grate bar base body. In principle, a screw connection, a pure adhesive bonding or similar is possible. Preferably, however the cover plate is connected positively to the grate bar base body. Further mechanical connecting parts such as screws or the like can then be dispensed with. In a preferred embodiment the grate bar base body is connected by means of a tongue and groove connection or a bung connection, particularly preferably by means of a swallowtail connection.

In a particularly preferred variant the grooves for the tongue and groove connection or bung connection are inserted in the grate bar base body in a side pointing towards the cover plate and/or in the cover plate in the side pointing towards the grate bar base body such that they extend from a first longitudinal edge of the grate bar up to a distance from an opposite second longitudinal edge of the grate bar. During mounting of the cover plate on the grate bar base body, the tongues for the connection are pushed from the first longitudinal edge of the grate bar into the grooves, i.e. in the case of a bung connection in which the tongue elements which are to engage in the groove are formed directly on the component in which the grooves are not located, it is then possible to push the cover plate and the grate bar base body out from the first longitudinal edge onto one another, i.e. transversely to the longitudinal direction in the course of the grooves. Since the grate bars subsequently lie adjacently to one another inside the firing grate in direct combination, the grooves are each covered by the grate bar disposed immediately adjacently to the opening of the grooves. As a result, the cover plate cannot slip down again to the side of the grate bar base body. In the same way, in the case of a tongue and groove connection, it is possible to insert the separate tongues from the first longitudinal edge of the grate bar into the grooves.

As already mentioned above, such grate bars are preferably used in firing grates having a number of grate steps arranged one above the other in the manner of roofing tiles, where a plurality of grate bars are mounted parallel adjacently to one another in each grate step. In particular in an embodiment of the connection between cover plate and grate bar base body as a tongue and groove or bung connection in which the grooves as described above extend from a first longitudinal edge of the grate bar into the grate bar base body and/or the cover plate, a grate step is preferably constructed such that the grooves each extend from the same (first) longitudinal edge of the grate bar into the grate bar base body and/or the cover plate. On this side (which lies in the direction of the said first longitudinal edge of the grate bars), the grate step has an optionally thinner terminating grate bar having a fixedly mounted ceramic surface which covers the grooves in the penultimate grate bar towards the side. Alternatively it is also possible to use a grate bar configured as laterally reversed in relation to the tongue and groove configuration with respect to the grate bar longitudinal axis at least as the last grate bar in the grate step, whose the cover plate can only be pushed out laterally precisely in the opposite direction as in the penultimate grate bar. In principle such laterally reversed grate bars can also be used at several points in the grate step. For example, two grate bars having a different groove direction can always be placed adjacent to one another in pairs so that they mutually block the movement of the cover plate from the grooves.

A firing grate fitted with grate bars according to the invention can in principle be used in a combustion chamber of any incinerator. It is particularly advantageous to use the grate bars according to the invention in the area of solid fuel combustion since very high temperatures are used here and in addition, a particular chemical resistance to unknown chemical compounds must be given.

Figure 2:
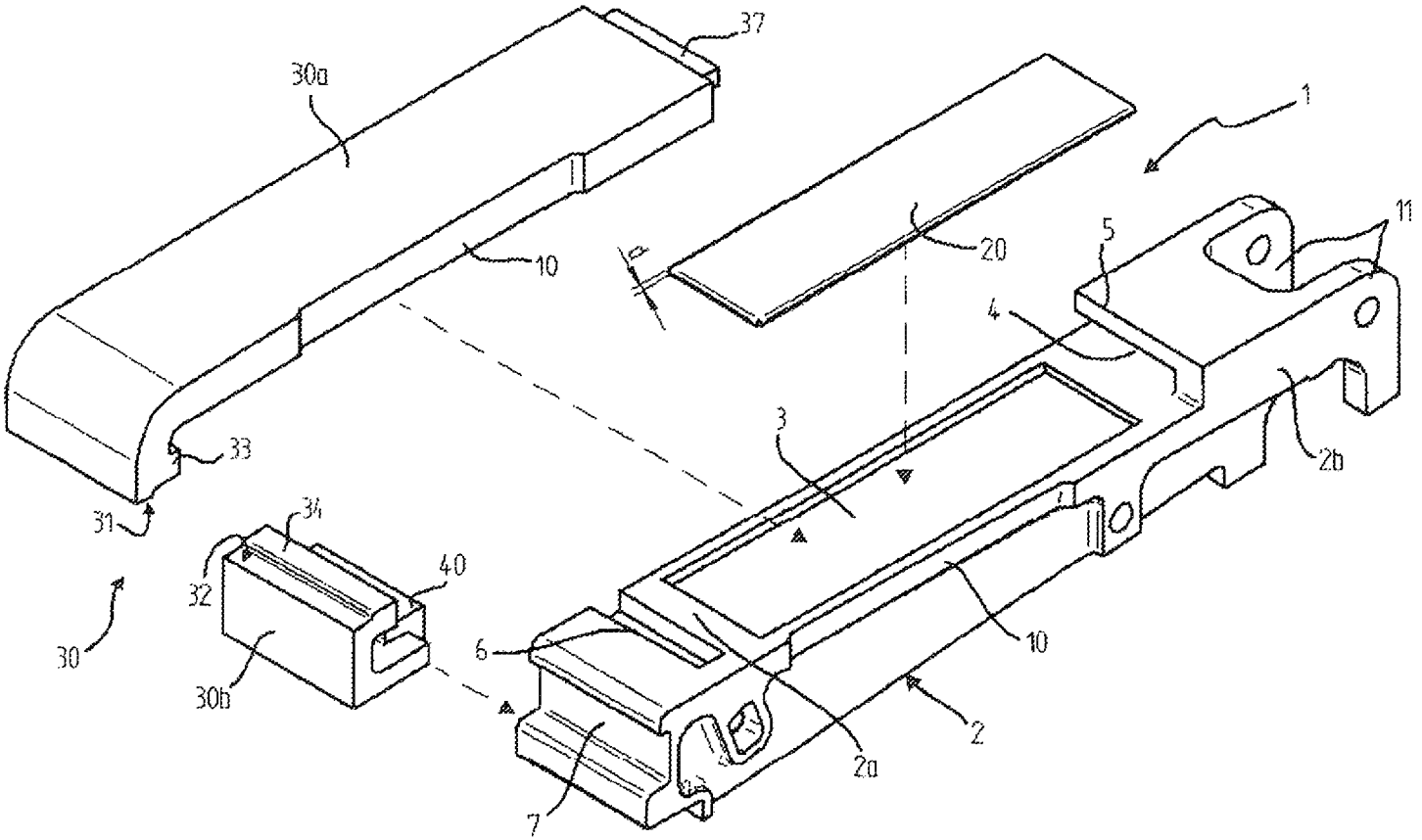
Figure 3:
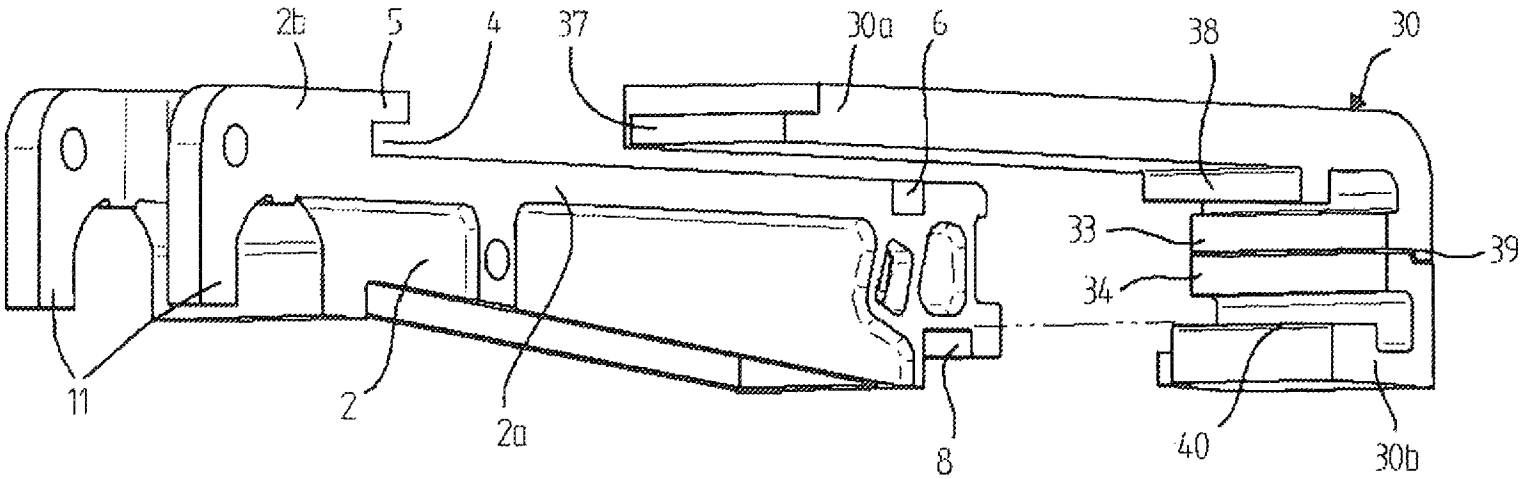
Figure 4:
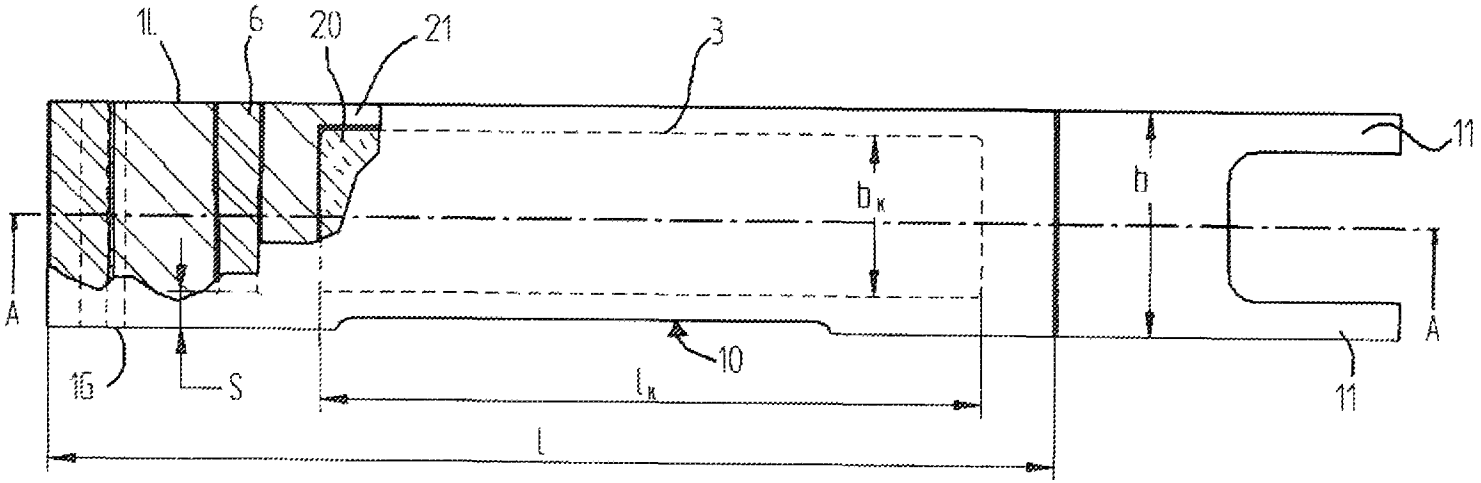
Figure 5:
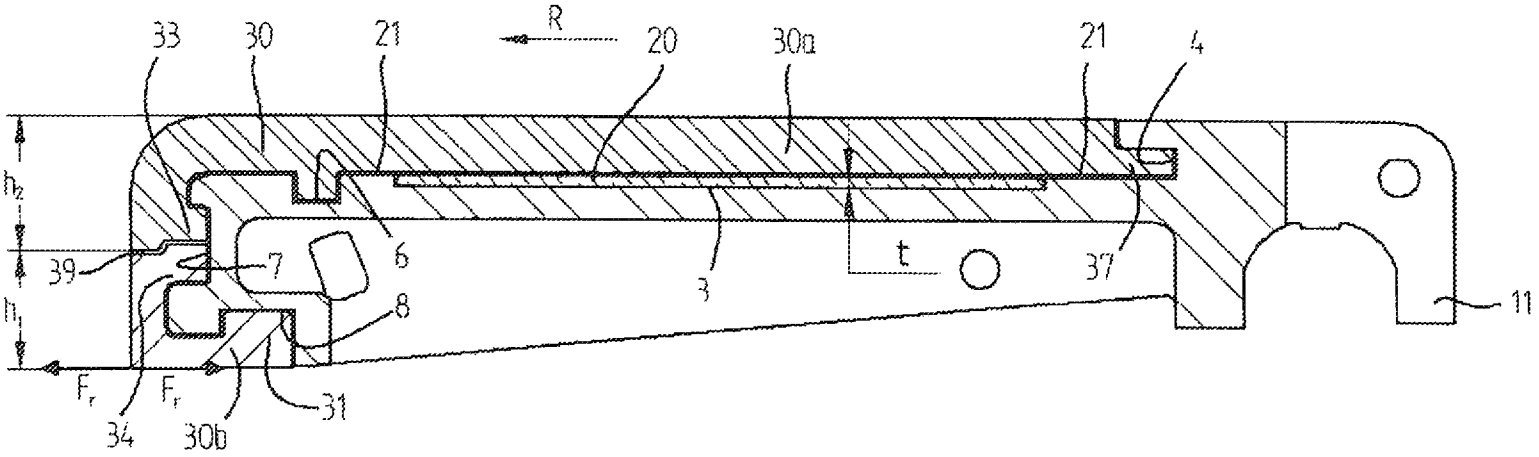
Figure 6:
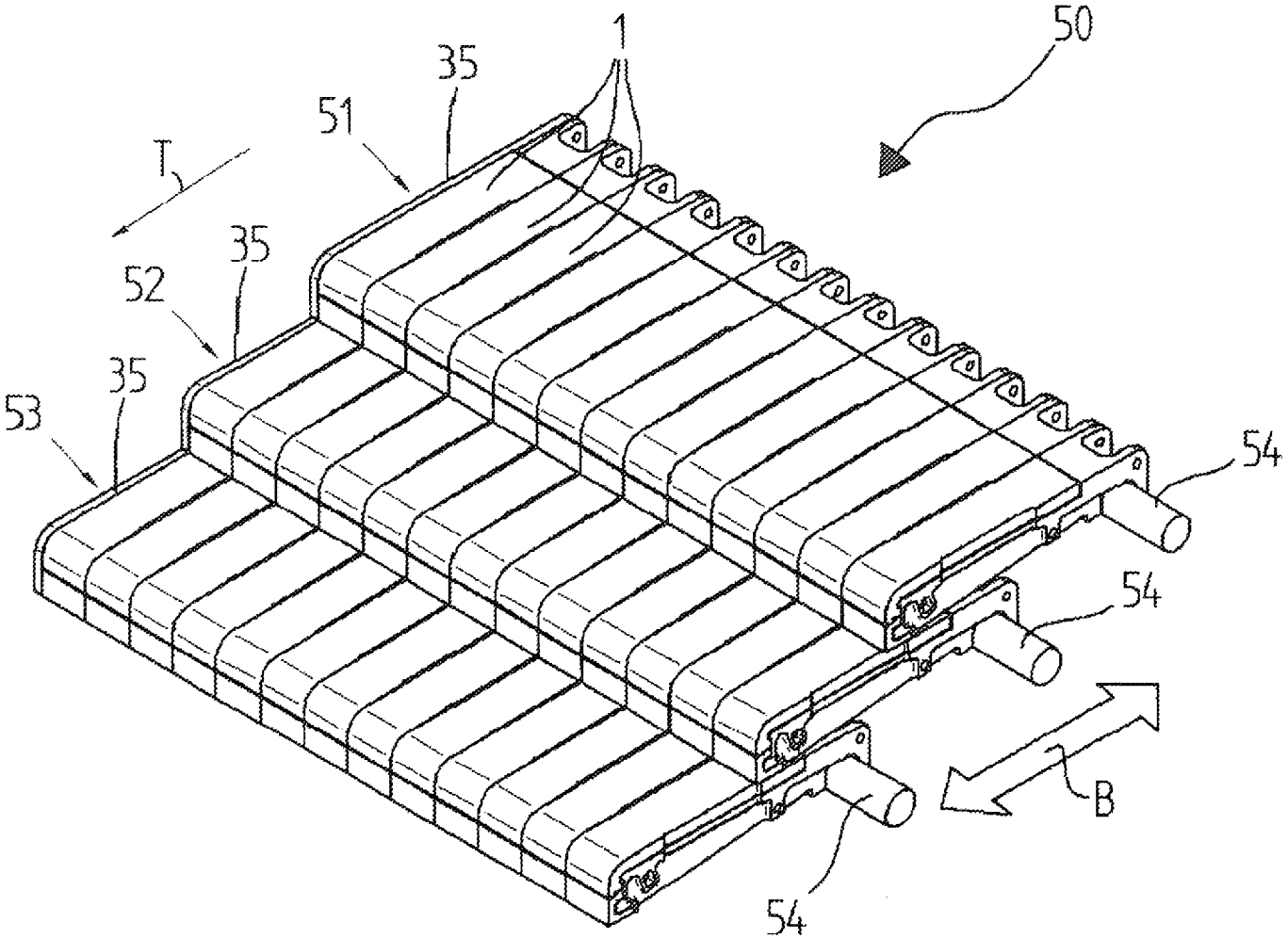
Figure 7:
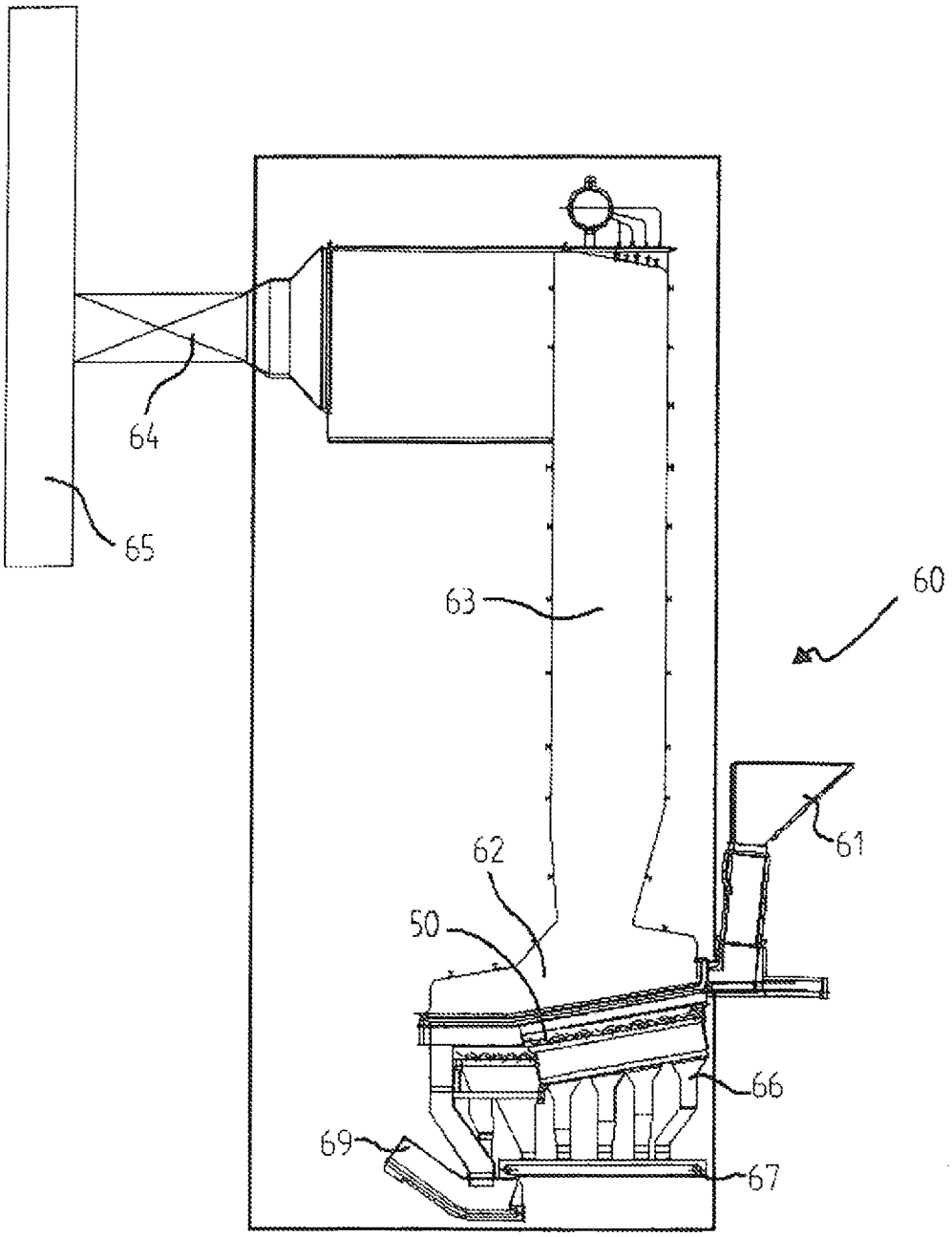

The invention is explained in detail hereinafter with reference to the appended figures by means of an exemplary embodiment. The same components are each provided with the same reference numbers in the different figures. In the figures:

FIG. 1 shows a perspective view of one exemplary embodiment of a grate bar according to the invention obliquely from above, FIG. 2 shows a perspective exploded view of the grate bar according to FIG. 1 obliquely from above, FIG. 3 shows a perspective exploded view of the grate bar according to FIG. 1 obliquely from below, FIG. 4 shows a plan view of the grate bar according to FIG. 1 with a partial section, FIG. 5 shows a longitudinal section through the grate bar according to FIG. 1 along the line of intersection A-A shown in FIG. 4, FIG. 6 shows a perspective view of three grate steps of a firing grate constructed of grate bars according to FIG. 1, FIG. 7 shows a simplified sectional view through a solid fuel incineration plant having a firing grate constructed of grate steps according to FIG. 6.

Without restricting the generality, it is assumed hereinafter that the grate bar shown in FIGS. 1 to 5 is used inside a solid fuel incineration plant.

This grate bar has a one-piece grate bar base body 2 made of cast steel extending in a longitudinal direction R (see FIG. 1). The grate bar base body 2 can substantially be divided into two sections, a front section 2*a* and a retaining section 2*b*.

The retaining section 2*b* is thereby located in the longitudinal direction on an end opposite the head side 1K or front side of the grate bar 1 and is formed with two hooks 11. As shown in the perspective view of a section of three grate steps 51, 52, 53 of a finished firing grate 50 in FIG. 6, this retaining element 2*b* is not exposed to the combustion chamber since the rear region of a grate bar 1 in a grate step 52, 53 is in each case covered by the grate bars 1 of the grate step 51, 52 located thereabove.

Only the front section 2*a* projects in each case below the grate bar 1 located thereabove. This region is therefore completely covered by a cover plate 30 of ceramic material. In the exemplary embodiment shown this comprises an SiC ceramic since this has a particularly good temperature strength, a high mechanical stability and additionally a relatively high insensitivity to chemical effects. This comprises a silicon-infiltrated reaction-bound SiC which consists of 88 wt. % SiC and 11 wt. % free silicon that is infiltrated into the SiC.

Since the grate bars 1 in each of the grate steps 51, 52, 53 are packed tightly adjacently to one another, the entire part of the grate bar 1 exposed directly to the burning fuel bed is covered by the ceramic cover plate 30.

As shown furthermore schematically in FIG. 6, the individual grate bars of a grate step 51, 52, 53 are mounted jointly with the hook 11 of the retaining section 2B of the grate bar base body 2 on a bearing rod 54 running perpendicularly to the longitudinal direction R of the grate bars 1 or a corresponding bearing rod. Neighbouring grate bars 1 can be screwed together by holes 12 running transversely to the longitudinal direction R in the hooks 11 so that the entire grate bars of a grate step 51, 52, 53 form a firm combination which is mounted on the respective bearing rod 54. Every other bearing rod 54, here the hearing rod 54 of the central grate step 52, is coupled to a mechanism (not shown) by which means the bearing rod 54 can be moved to and fro in a direction of movement B parallel to the grate bar longitudinal direction R so that the entire grate step 52 is moved to and fro in the direction of movement B. In this way the fuel bed is transported further obliquely downwards from grate step to grate step. This movement of every other grate step 52 additionally leads to a mechanical loading since the grate bars of a grate step located thereabove in each case slide to and fro with a front foot area 1F (see FIG. 1) on the upper side region 1S of the grate step located thereunder. For this reason the ceramic cover plate 30 is configured so that it is guided completely around the head side 1K of the grate bar 1 and covers the foot area 1F.

The grate bars 1, i.e. both the grate bar base body 2 and also the cover plate 30 of each grate bar 1 are not designed completely rectangularly when viewed from above in the area of the front section 2*a* but each have a recess 10 on one longitudinal side. These recesses 10 each form the ventilation slots between the grate bars 1 through which air can be blown in from below into the firing grate in order to firstly maintain the combustion process and secondly cool the grate bars by the introduced air.

According to the invention, as can be seen particularly well in FIG. 2, a larger continuous cavity 3 is inserted in the upper side of the front section 2*a* of the grate bar base body 2 which is covered by the cover plate 30. This cavity 3 extends over the largest part of the surface of the front section 2*a*.

A ceramic fibre insulating mat 20 is inserted in this cavity 3 before covering with the ceramic cover plate 30. This can easily be used at average temperatures of 800 to 1000° C. and can be used briefly even at temperatures up to 1200° C.

The entire further surface portion around the cavity 3, i.e. the webs remaining laterally on the grate bar base body 2 and all the wide regions of the grate bar base body 2 on which the ceramic cover plate 30 would rest directly, are provided with a very thin insulating cement layer 21 which serves to compensate for unevennesses. The insulating mat 20 and the layer of insulating cement 21 ensures that the grate bar base body 2 made of cast steel is very well thermally insulated compared with the high-temperature resistant cover plate 30 made of ceramic material. The grate bar base body 2 therefore only needs to absorb a fraction of the thermal stress acting on the ceramic cover plate 30 of the grate bar 1.

The dimensions of the cavity 3 are preferably selected so that the width $b_K$ of the cavity 3 is at least 90% of the total width b of the grate bar 1 and the length $l_K$ of the cavity 3 corresponds to at least 70% of the length l of the cover plate 30 calculated from the head side 1K of the grate bar 1 up to the rear-side end of the cover plate 30 at which this adjoins the retaining section 2*b* of the grate bar base body 2. That is, when a dimension of the cover plate has a length l of 560 mm, the length $l_K$ of the cavity is preferably 392 mm and when a width b of the grate bar 1 is 140 mm, the width $b_K$ of the cavity is about 126 mm. The size of the cavity 3 is preferably selected so that the available surface in the grate bar base body 2 is used as well as possible and the peripheral walls around the cavity 3 are as thin as possible since in the area of these remaining "webs" even when using the insulating cement, only a lower thermal insulating effect can be achieved compared with that in the area of the cavity 3 in which the ceramic fibre insulating mat 20 is inserted.

The thickness d of the ceramic fibre insulating mat 20 is selected so that it corresponds as accurately as possible to the depth t (see FIG. 5) of the cavity 3 plus the layer thickness of the insulating cement 21. The cavity 3 is then completely filled and the insulating mat 20 is not compressed at all or at most minimally compressed between the ceramic cover plate 30 and the grate bar base body 2 so that the maximum thermal insulating effect can be achieved.

The cover plate 30 is formed in two parts here, comprising an upper part plate 30*a* which covers the front section 2*a* of the grate bar base body 2 in the upper side area 1S of the grate bar 1 and the upper part of the head side 1K of the grate bar 1, and a separate head part 30*b* which covers the lower area of the head side 1K of the grate bar 1 and extends at the bottom over the foot area 1F of the grate bar 1.

The separation point 39 between the two parts 30*a*, 30*b* of the cover plate 30 runs centrally on the head side 1K of the grate bar 1. The boundary surfaces 31, 32 of the upper part plate 30*a* and the head part 30*b* of the cover plate 30 are each configured to be stepped in a manner corresponding to one another so that the separation point 39 when viewed in cross-section runs in a corresponding stepped manner in the grate bar longitudinal direction R (see FIG. 5).

The division of the ceramic cover plate 30 into an upper part plate 30*a* and a head part 30*b* has the advantage that frictional forces $F_R$, acting on the cover plate 30 on the front edge in the foot area 1F cannot have the result that a too-large mechanical torque M can act on the cover plate 30 in the area of the transition edge from the upper side 1S to the head side 1K of the grate bar 1. As shown in FIG. 5, this torque M caused by the force $F_R$ in the area of the upper front edge of the grate bar 1 would be $$M=F_R\times(h_1+h_2)$$

where $h_1$ is the height from the foot edge as far as the separation point 39 between head part 30*b* and upper part plate 30 and $h_2$ is the distance from this separation point 39 as far as the said position on the upper front edge of the cover plate 30 at which the torque would act on the cover plate and could there result in a break.

Instead, due to the division of the cover plate 30 at the separation point 39 only a torque $$M=F_R\times h_1$$

acts on the head part 30*b* itself since the upper part plate 30*a* and the head part 30*b* are configured such that a certain play remains at the separation point 39. This is possibly due to the stepped configuration of the boundary surfaces 31, 32 described above without the grate bar base body 2 being exposed at this point so that it is ensured that the separation point is relatively tightly sealed with respect to possibly incoming liquid and/or fine-particle fuel. The torque therefore has no effects on the upper front edge of the cover plate 30, i.e. the mechanical stresses due to the continuous movements of every other grate step 52 do not lead to an increased risk of rupture in the ceramic cover plate 30 and do not reduce the service life of the grate bar 1.

In the exemplary embodiment shown the connection of the ceramic cover plate 30 to the grate bar base body 2 is made purely by form closure, i.e. by a so-called bung connection, i.e. a tongue-and-groove connection where grooves 4, 6, 7, 8 are incorporated in one of the two components to be connected, here in the grate bar base body 2, and the tongues fitting thereto are formed directly on the other component to be connected, here on the ceramic cover plate 30.

For this purpose the grate bar base body 2 has a total of four grooves 4, 6, 7, 8. A first groove 4 extends parallel to the surface of the grate bar base body 2 towards the back into the retaining section 2*b* so that a type of lug 5 is formed above this groove 4 in the retaining section 2*b*. Accordingly a tongue 37 is formed on the ceramic cover plate 30 or the upper part plate 30*a* thereof at the end pointing away from the head side 1K of the grate bar 1, which extends parallel to the surface of the upper part plate 30. This tongue 37 can be inserted into the groove 4 under the lug 5 in the retaining section 2*b* during assembly. Another groove 6 is located in the front section 2*a* of the grate bar base body 2 between the front side of the grate bar base body 2 and the recess 3. Accordingly, the upper part plate 30*a* has a tongue 38 formed on the underside pointing to the grate bar base body 2, which tongue engages in this groove 6.

Additionally located in the base body 2 in the head side 1K is a larger groove 7 into which corresponding tongues 33, 34 engage, which extend inwards to the grate bar base body 2 on the head-side end of the upper part plate 30*a* and the head part 30*b*. That is, the tongue engaging here on the ceramic cover plate 30 is divided at the separation point 39 into two sub-tongues 33, 34 where one sub-tongue 33 is located on the upper part plate 30*a* and the second sub-tongue 34 is located on the head part 30*b* of the cover plate 30.

Additionally located in the grate bar base body 2 on the underside in the foot area 1F is another groove 8 into which a tongue 40 engages, which is attached on the foot-side end of the head part 30*b* of the ceramic plate 30 and extends from the foot area upwards.

The grooves 4, 6, 7 and 8 and the corresponding tongues 37, 38, 33, 34 and 40 are preferably configured to be trapezoidal in cross-section, expanding slightly towards the groove base so that a swallowtail-like connection is thereby given in order to ensure a secure hold.

The groove 4 in the retaining section 2*b*, the groove 6 in the upper side of the front section 2*a* and the groove 8 in the foot area of the grate bar base body 2 each run from a first longitudinal edge 1L into the grate bar base body 2 and end at a distance s from the opposite second longitudinal edge 1G of the grate bar 1 (see in particular in FIG. 4). The distance s is preferably 10 to 30 mm. That is the grooves 4, 6, 8 do not run completely from one side to the other transversely through the base body 2. Accordingly, the tongues 37, 38, 40 formed on the cover plate 30 are shorter. This configuration of the grooves and tongues has the advantage that the upper plate part 30*a* and the head part 30*b* can only be pushed onto the grate bar base body 2 from the first longitudinal side 1L. If an adjacent grate bar then abuts subsequently against this first longitudinal edge 1L in combination within a grate step 51, 52, 53 (see FIG. 6). the two-part cover plate 30 can no longer slip out from the grooves in this direction and is securely fixed without further retaining means being required.

In order to prevent the cover plate 30 from being able to be released from the grate bar base body 2 by slipping out laterally from the grooves in a grate step 51, 52, 53 on the grate bar 1 located as the last in the grate step 51, 52, 53 in the side pointing in the direction of the first longitudinal side 1L of the grate bars 1, a thinner grate bar terminating plate 35 is located in each grate step on this side.

A firing grate constructed from such grate steps 51, 52, 53 with the grate bars 1 according to the invention can be used in a solid fuel incineration plant 60 as shown in FIG. 7. The firing grate 50 is located at the bottom in the combustion chamber 62 in this case. The solid fuel to be burnt is fed continuously to this combustion chamber 62 via a feed shaft 61. During combustion the fuel bed in the combustion chamber 62 is continuously transported obliquely downwards over the firing grate 50 due to the feed movements of every other grate step. The upper area pointing towards the feed shaft 61 on the firing grate 50 is thereby a drying and degassing zone, the main combustion takes place in the central area and post-combustion in the lower area.

Located below the firing grate 50 are hopper-like ash collectors 66 which collect the ash produced during combustion, which drops down through the air slots between the grate bars, and supply it to subsequent conveying devices 67. A slag conveying device 69 is located at the lower end of the firing grate. The ash and slag are further removed by suitable devices not shown here in detail. Boiler flues 63 through which the flue gas is guided are located above the combustion chamber 62 so that this gas delivers its energy to the heating surfaces of the boiler flues. The cooled flue gas is then passed through a filter plant 64 shown only roughly schematically and the filtered flue gases then emerge from the solid fuel incineration plant 60 via an outlet 65. It is expressly noted that the solid fuel incineration plant in FIG. 7 is shown only roughly schematically since the structure of such solid fuel incineration plants is known in principle to the person skilled in the art, and the other components, in particular the devices for collecting and removing the ash and slag, for filtering the flue gases and for delivering the fuel into the incinerator plant are not essential for the invention.

It is finally pointed out once again that the grate bars and grate bar steps or the firing grate and the incinerator plant described previously are merely exemplary embodiments which can be modified by the person skilled in the art in various ways without restricting the scope of the invention.

Since the grate bars even with simple air cooling achieve service lives such as can otherwise only be achieved with water cooling, they are preferably used for constructing air-cooled firing grates in order, for example, to replace water-cooled grate bars as has been explained previously. This, however, does not eliminate the fact that the invention can be additionally used within the framework of water-cooled grate bars in order to further increase the service lives or construct the firing grates for even higher temperature applications.

Furthermore, the use of the indefinite article "a" or "one" does not exclude the fact that the features concerned can also be present in a plurality.

The invention claimed is:

1. A grate bar for an incinerator, comprising a grate bar base body, and a high temperature resistant cover plate covering the grate bar base body at least on a surface portion which in operation is exposed to a combustion chamber, the cover plate completely covering the grate bar base body in a front foot region, on a forward head side and on an upper side region of the grate bar base body, the cover plate being formed in two parts including an upper part plate and a head part, the upper part plate and the head part adjoining one another at a width-wise extending separation point located on the head side, the separation point running transversely to a longitudinal direction of the grate bar base body at an approximate mid-height between the front foot region and the upper side region of the grate bar base body.

2. The grate bar according to claim 1, further comprising a thermal insulating material provided between the cover plate and the grate bar base body; and a cavity having peripheral walls in the grate bar base body in a side pointing towards the cover plate and/or in the cover plate in the side pointing towards the grate bar base body, said cavity is at least partially filled with a ceramic fibre insulating material.

3. The grate bar according to claim 2, wherein the ceramic fibre insulating material includes a ceramic fibre insulating mat.

4. The grate bar according to claim 2 wherein a depth of the cavity and a layer thickness of the ceramic fibre insulating material are selected so that in the assembled state the ceramic fibre insulating material is not pre-tensioned or is pre-tensioned at most by a defined amount between the grate bar base body and the cover plate.

5. The grate bar according to claim 2, wherein the thermal insulating material is one of an insulating cement layer or insulating adhesive layer that is located between the grate bar base body and the cover plate in areas located adjacent to the cavity.

6. The grate bar according to claim 5, wherein the insulating cement layer or the insulating adhesive layer is located between the grate bar base body and the cover plate around the cavity.

7. The grate bar according to claim 2, wherein the cavity extends at least over 80% of a width of the cover plate and/or at least 60% of a length of the cover plate.

8. The grate bar according to claim 1, wherein the cover plate is connected positively to the grate bar base body.

9. The grate bar according to claim 8, wherein the cover plate is connected to the grate bar base body by a tongue and groove connection and/or bung connection.

10. The grate bar according to claim 8, wherein grooves for the tongue and groove connection and/or bung connection are inserted in a side pointing towards the cover plate in the grate bar base body and/or in the side pointing towards the grate bar base body in the cover plate, the grooves extend from a first longitudinal edge of the grate bar transversely for a distance from an opposite second longitudinal edge of the grate bar.

11. A firing grate comprising a number of grate steps arranged one above the other in a manner of roofing tiles, the grate steps each include a plurality of grate bars mounted parallel to one another, wherein at least a part of the grate bars are formed according to claim 1.

12. An incinerator, for solid fuel combustion having a combustion chamber which has a firing grate according to claim 11 in a lower area.

13. A method for producing a grate bar for an incinerator, comprising completely covering a grate bar base body with a high temperature resistant cover plate at least on a forward and an upper surface portion which in operation is exposed to a combustion chamber, the cover plate being manufactured in two parts including an upper part plate which covers the grate bar base body in an upper side area and on a forward head side of the grate bar base body up to a separation point, the separation point running transversely to a longitudinal direction of the grate bar base body on the forward head side at an approximate mid-height between a front foot area and the upper side area of the grate bar base body, and a head part of the cover plate which, starting from the separation point, covers the grate bar base body, a remainder of the head side and the front foot area of the grate bar.

14. The method according to claim 13, wherein during assembly of the grate bar base body and the cover plate a thermal insulating material is inserted between the cover plate and the grate bar base body;

during manufacture of the grate bar base body, a cavity is inserted in the grate bar base body in a side pointing towards the cover plate and/or during manufacture of the cover plate is inserted in the cover plate in a side pointing towards the grate bar base body, and prior to assembly of the grate bar base body and the cover plate, the cavity is filled at least partially with a ceramic fibre insulating material.

15. The method according to claim 14, wherein grooves for a tongue and groove connection and/or bung connection are inserted in the grate bar base body in a side pointing towards the cover plate and/or in the cover plate in the side pointing towards the grate bar base body, the grooves extend from a first longitudinal edge of the grate bar for a distance from an opposite second longitudinal edge of the grate bar and during mounting of the cover plate on the grate bar base body tongues are pushed from the first longitudinal edge of the grate bar into the grooves.

* * * * *